US009412482B2

(12) United States Patent
Kamada et al.

(10) Patent No.: US 9,412,482 B2
(45) Date of Patent: Aug. 9, 2016

(54) CU-NI-CO-SI BASED COPPER ALLOY SHEET MATERIAL AND METHOD FOR PRODUCING THE SAME

(71) Applicant: DOWA METALTECH CO., LTD., Tokyo (JP)

(72) Inventors: Toshiya Kamada, Tokyo (JP); Takashi Kimura, Tokyo (JP); Weilin Gao, Tokyo (JP); Fumiaki Sasaki, Tokyo (JP); Akira Sugawara, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 406 days.

(21) Appl. No.: 14/068,256

(22) Filed: Oct. 31, 2013

(65) Prior Publication Data

US 2014/0116583 A1 May 1, 2014

(30) Foreign Application Priority Data

Oct. 31, 2012 (JP) ..... 2012-239934

(51) Int. Cl.
*C22C 9/06* (2006.01)
*H01B 1/02* (2006.01)
*C22F 1/08* (2006.01)

(52) U.S. Cl.
CPC *H01B 1/026* (2013.01); *C22C 9/06* (2013.01); *C22F 1/08* (2013.01); *C21D 2201/05* (2013.01); *C21D 2211/004* (2013.01)

(58) Field of Classification Search
CPC ..... C21D 2201/05; C21D 2211/004; C22C 9/06; C22F 1/08; H01B 1/026
USPC ..... 148/435, 414
See application file for complete search history.

(56) References Cited

U.S. PATENT DOCUMENTS 4,016,010 A * 4/1977 Caron ..... C22F 1/08 148/411
2008/0011396 A1* 1/2008 Kaneko ..... C22C 9/02 148/684

FOREIGN PATENT DOCUMENTS

| | | |
|---|---|---|
| JP | 2008-248333 | 10/2008 |
| JP | 2009-007666 | 1/2009 |
| JP | 2011-084764 | 4/2011 |
| JP | 2011-231393 | 11/2011 |
| JP | 2011-252188 | 12/2011 |
| WO | WO 2009123136 | * 10/2009 |
| WO | 2011/068134 | 6/2011 |

* cited by examiner

*Primary Examiner* — Sikyin Ip
(74) *Attorney, Agent, or Firm* — Clark & Brody

(57) ABSTRACT

A Cu—Ni—Co—Si based copper alloy sheet material has second phase particles existing in a matrix, with a number density of ultrafine second phase particles is $1.0\times10^9$ number/mm$^2$ or more. A number density of fine second phase particles is not more than $5.0\times10^7$ number/mm$^2$. A number density of coarse second phase particles is $1.0\times10^5$ number/mm$^2$ or more and not more than $1.0\times10^6$ number/mm$^2$. The material has crystal orientation satisfying the following equation (1):

$$I\{200\}/I_0\{200\}\geq3.0 \quad (1)$$

wherein I{200} represents an integrated intensity of an X-ray diffraction peak of the {200} crystal plane on the sheet material sheet surface; and $I_0\{200\}$ represents an integrated intensity of an X-ray diffraction peak of the {200} crystal plane in a pure copper standard powder sample.

2 Claims, No Drawings

CU-NI-CO-SI BASED COPPER ALLOY SHEET MATERIAL AND METHOD FOR PRODUCING THE SAME

TECHNICAL FIELD

The present invention relates to a Cu—Ni—Co—Si based copper alloy sheet material suitable for electrical or electronic parts such as connectors, lead frames, relays, and switches, which is particularly contemplated to decrease a factor of bending deflection, and to a method for producing the same.

BACKGROUND ART

Materials which are used for electrical or electronic parts as electric current carrying parts such as connectors, lead frames, relays, and switches are not only required to have good "electrical conductivity" for the purpose of suppressing the generation of Joule heat due to electric current conduction but required to have high "strength" for withstanding a stress given at the time of assembling or operation of an electrical or electronic appliance. In addition, electrical or electronic parts such as connectors are also required to have excellent bending workability because they are in general formed by bending work after stamping.

In particular, in recent years, in electrical or electronic parts such as connectors, downsizing and weight reduction tend to advance. Following this, in sheet materials of a copper alloy as a base material, a requirement for thinning (for example, a sheet thickness is not more than 0.15 mm, and moreover not more than 0.10 mm) is increasing. For that reason, a strength level and an electrical conductivity level required in the base material become much stricter. Specifically, base materials having not only a strength level such that the 0.2% yield strength is 950 MPa or more but an electrical conductivity level in which the electrical conductivity is 30% IACS or more are desired.

In addition, in electrical or electronic parts such as connectors, a "factor of bending deflection" is used at the time of designing because they are in general formed by bending work after stamping. The factor of bending deflection means an elastic modulus at the time of a bending test, and when the factor of bending deflection is lower, it is possible to increase the amount of bending deflection until the permanent deformation is started. In particular, in recent years, in order to respond to not only the design to permit a scattering in sheet thickness or residual stress of the base material but a need to attach importance to an "inserting feeling" of a terminal portion in practical use, a structure which undergoes large spring displacement is demanded. For that reason, in mechanical properties of the base material, it is advantageous that the factor of bending deflection in the rolling direction is small as not more than 95 GPa, and preferably not more than 90 GPa.

Examples of a representative high strength copper alloy include a Cu—Be based alloy (for example, C17200; Cu—2% Be), a Cu—Ti based alloy (for example, C19900; Cu—3.2% Ti), and a Cu—Ni—Sn based alloy (for example, C72700; Cu—9% Ni-6% Sn). However, from the viewpoints of cost and environmental load, in recent years, a tendency to keep the Cu—Be based alloy at a respectful distance (so-called deberyllium orientation) has become strong. In addition, the Cu—Ti based alloy and the Cu—Ni—Sn based alloy have a modulated structure (spinodal structure) in which the solid solution elements have a periodic concentration fluctuation within a matrix and have high strength. However, there is involved such a drawback that the electrical conductivity is low as, for example, from about 10 to 15% IACS.

On the other hand, a Cu—Ni—Si alloy based (so-called Corson alloy) is watched as a material that is relatively excellent in a balance of properties between strength and electrical conductivity. For example, a Cu—Ni—Si based copper alloy sheet material can be adjusted to a 0.2% yield strength of 700 MPa or more while keeping a relatively high electrical conductivity (from 30 to 50% IACS) through steps on the basis of solution treatment, cold-rolling, aging treatment, finish cold-rolling, and low temperature annealing. However, in this alloy system, it is not always easy to respond to higher strength.

As a means for realizing high strength of the Cu—Ni—Si based copper alloy sheet material, general methods such as addition of large amounts of Ni and Si and increase of a finish rolling (temper rolling treatment) ratio after the aging treatment are known. The strength increases with an increase of the addition amounts of Ni and Si. However, when the addition amounts exceed a certain extent (for example, Ni: about 3%, Si: about 0.7%), the increase of the strength tends to be saturated, and it is extremely difficult to attain a 0.2% yield strength of 950 MPa or more. In addition, the excessive addition of Ni and Si easily brings a lowering of the electrical conductivity or a lowering of bending workability due to coarsening of a Ni—Si based precipitate. On the other hand, it is also possible to enhance the strength due to an increase of the finish rolling ratio after the aging treatment. However, when the finish rolling ratio increases, the bending workability, in particular, bending workability in "bad way bending" with the rolling direction as a warped axis is conspicuously deteriorated. For that reason, even when the strength level is high, there may be the case where the Cu—Ni—Si copper based alloy sheet material cannot be worked into an electrical or electronic part.

CITATION LIST

Patent Literatures

Patent Literature 1: JP-A-2008-248333 ("JP-A" means unexamined published Japanese patent application)
Patent Literature 2: JP-A-2009-7666
Patent Literature 3: WO2011/068134
Patent Literature 4: JP-A-2011-252188
Patent Literature 5: JP-A-2011-84764
Patent Literature 6: JP-A-2011-231393

SUMMARY OF INVENTION

Problems to be Solved by the Invention

A Cu—Ni—Co—Si based alloy having Co added thereto is known as an improved system of the Cu—Ni—Si based alloy. Similar to Ni, Co forms a compound with Si, and therefore, a strengthening effect to be brought due to a Co—Si precipitate is obtained. As examples in which it is contemplated to improve the properties using the Cu—Ni—Co—Si based alloy, the following literatures are exemplified.

Patent Literature 1 discloses that the strength is enhanced through a combination of control of the number density of second phase particles by suppression of a coarse precipitate with work hardening in a Cu—Ni—Co—Si based alloy. However, its strength level is from about 810 to 920 MPa in terms of 0.2% yield strength but does not reach 950 MPa. Patent Literature 2 discloses that the mechanical properties are enhanced by controlling the average crystal particle diameter and the crystal texture. However, its strength level is low as from 652 to 867 MPa in terms of a 0.2% yield strength. Patent Literature 4 discloses that the particle size distribution of precipitates is optimized, thereby improving especially anti-setting property. Even in this case, high strength such that the 0.2% yield strength is 950 MPa or more is not realized.

Patent Literature 3 discloses a Cu—Ni—Co—Si based alloy realizing a 0.2% yield strength of 1,000 MPa, too by controlling the crystal texture to enhance the properties. However, in materials in which the 0.2% yield strength is adjusted to 940 MPa or more, the factor of bending deflection becomes high as 100 GPa or more, so that it is noted that it is difficult to make both high strength and low factor of bending deflection compatible with each other.

Patent Document 5 exemplifies Cu—Ni—Co—Si based alloys having an X-ray diffraction intensity ratio: $I\{200\}/I_0\{200\}$ of from 0.2 to 3.5. However, in those alloys of $I\{200\}/I_0\{200\}$ of 3.0 or more, the 0.2% yield strength of 950 MPa or more is not realized. Patent Literature 6 discloses a Cu—Ni—Co—Si based copper alloy sheet material having a high area ratio of particles with cube orientation and a 0.2% yield strength of 950 MPa or more. However, according to investigations made by the present inventors, it was noted that according to the technology disclosed in the patent literature, it is difficult to obtain those copper alloy sheet materials having a low factor of bending deflection as not more than 95 MPa.

In the light of the above, in a copper alloy sheet material, it was not easy to make both high strength and a decrease of factor of bending deflection compatible with each other at high levels. In view of the foregoing problems of the related art, an object of the present invention is to provide a Cu—Ni—Co—Si based copper alloy sheet material having high strength of 950 MPa or more in terms of a 0.2% yield strength and simultaneously having a factor of bending deflection of not more than 95 GPa while keeping an electrical conductivity of 30% IACS or more and satisfactory bending workability.

Means for Solving the Problems

The above-described object is achieved by a copper alloy sheet material having a chemical composition containing from 0.80 to 3.50% by mass of Ni, from 0.50 to 2.00% by mass of Co, from 0.30 to 2.00% by mass of Si, from 0 to 0.10% by mass of Fe, from 0 to 0.10% by mass of Cr, from 0 to 0.10% by mass of Mg, from 0 to 0.10% by mass of Mn, from 0 to 0.30% by mass of Ti, from 0 to 0.20% by mass of V, from 0 to 0.15% by mass of Zr, from 0 to 0.10% by mass of Sn, from 0 to 0.15% by mass of Zn, from 0 to 0.20% by mass of Al, from 0 to 0.02% by mass of B, from 0 to 0.10% by mass of P, from 0 to 0.10% by mass of Ag, from 0 to 0.15% by mass of Be, and from 0 to 0.10% by mass of REM (rare earth element), with the balance being Cu and inevitable impurities, wherein in second phase particles existing in a matrix, a number density of "ultrafine second phase particles" having a particle diameter of 2 nm or more and less than 10 nm is $1.0\times10^9$ number/mm$^2$ or more, a number density of "fine second phase particles" having a particle diameter of 10 nm or more and less than 100 nm is not more than $5.0\times10^7$ number/mm$^2$, and a number density of "coarse second phase particles" having a particle diameter of 100 nm or more and not more than 3.0 μm is $1.0\times10^5$ number/mm$^2$ or more and not more than $1.0\times10^6$ number/mm$^2$; and having a crystal orientation satisfying the following equation (1):

$$I\{200\}/I_0\{200\}\geq3.0 \quad (1)$$

wherein $I\{200\}$ represents an integrated intensity of an X-ray diffraction peak of the {200} crystal plane on the copper alloy sheet material sheet surface; and $I_0\{200\}$ represents an integrated intensity of an X-ray diffraction peak of the {200} crystal plane in a pure copper standard powder.

The copper alloy sheet material is fully provided with such properties that a 0.2% yield strength in the rolling direction is 950 MPa or more, a factor of bending deflection in the rolling direction is not more than 95 GPa, and an electrical conductivity is 30% IACS or more. It is to be noted that in the present invention, Y (yttrium) is dealt as REM (rare earth element).

As a method for producing the above-described copper alloy sheet material, there is provided a production method comprising a step of subjecting a copper alloy sheet material intermediate product having the above-described chemical composition, having gone through a treatment of applying rolling work at a rolling ratio of 85% or more in a temperature range of not higher than 1,060° C. and 850° C. or higher, and having a metal texture in which a number density of "coarse second phase particles" having a particle diameter of 100 nm or more and not more than 3.0 μm is $1.0\times10^5$ number/mm$^2$ or more and not more than $1.0\times10^6$ number/mm$^2$, and a number density of "fine second phase particles" having a particle diameter of 10 nm or more and less than 100 nm is not more than $5.0\times10^7$ number/mm$^2$, to a solution treatment with a heat pattern of temperature rising to 950° C. or higher such that a temperature rise rate of from 800° C. to 950° C. is 50° C./sec or more and then holding at from 950 to 1,020° C.; and a step of subjecting the material having metal texture and crystal orientation after the solution treatment to an aging treatment at from 350 to 500° C.

In the above-described solution treatment, a crystal orientation satisfying the foregoing equation (1) can be obtained.

The above-described copper alloy sheet material intermediate product can be formed by subjecting a copper alloy ingot having the above-described chemical composition to hot-rolling at a rolling ratio of 85% or more in a temperature range of not higher than 1,060° C. and 850° C. or higher and at a rolling ratio of 30% or more in a temperature range of lower than 850° C. and 700° C. or higher, followed by cold-rolling.

After the aging treatment, it is effective for increasing the strength level to apply finish cold-rolling in the range of the rolling ratio at which the crystal orientation satisfying the foregoing equation (1) is kept. After the finish cold-rolling, low temperature annealing can be applied in the range of from 150 to 550° C.

Advantages of the Invention

According to the present invention, it is possible to realize a copper alloy sheet material with satisfactory bending workability, which has properties of an electrical conductivity of 30% IACS or more, a 0.2% yield strength of 950 MPa or more, and a factor of bending deflection is small, it is possible to increase the amount of bending deflection until the permanent deformation is started, but in view of the fact that the 0.2% yield strength is high, it is possible to improve an "inserting feeling" of a terminal portion in electric current conduction parts such as connectors and lead frames.

EMBODIMENTS FOR CARRYING OUT THE INVENTION

As a result of investigations, the present inventors have obtained the following knowledge.

(a) In a Cu—Ni—Co—Si based copper alloy sheet material, by controlling a number density of each of "fine second phase particles" having a particle diameter of 10 nm or more and less than 100 nm and "coarse second phase particles" having a particle diameter of 100 nm or more and not more than 3.0 μm to a prescribed range and increasing a proportion of crystal particles having the {200} crystal plane parallel to the sheet surface, it is possible to lower the factor of bending deflection.

(b) By sufficiently ensuring a number density of "ultrafine second phase particles" having a particle diameter of 2 nm or more and less than 10 nm, a high strength level is obtained without impairing a lowering of the above-described factor of bending deflection.

(c) By sufficiently forming "coarse second phase particles" by hot-rolling and then applying a solution treatment requiring rapid heating in a temperature rise process, it is possible to realize a copper alloy sheet material having metal texture and crystal orientation as set forth above in (a) and (b).

The present invention has been accomplished on the basis of such knowledge.

[Second Phase Particles]

The Cu—Ni—Co—Si based alloy exhibits a metal texture in which second phase particles exist in a matrix composed of an fcc crystal. The second phase particles are a crystallized product formed at the time of solidification in a casting step and a precipitate formed in a subsequent production step. In the case of the alloy concerned, it is constituted mainly of a Co—Si based intermetallic compound phase and an Ni—Si based intermetallic compound phase. In this specification, the second phase particles observed in the Cu—Ni—Co—Si based alloy are classified into the following four types.

(i) Ultrafine second phase particles: Particles having a particle diameter of 2 nm or more and less than 10 nm and formed by an aging treatment after the solution treatment. These particles contribute to enhancement of the strength.

(ii) Fine second phase particles: Particles having a particle diameter of 10 nm or more and less than 100 nm. These particles do not substantially contribute to enhancement of the strength but bring an increase of the factor of bending deflection.

(iii) Coarse second phase particles: Particles having a particle diameter of 100 nm or more and not more than 3.0 μm. These particles do not substantially contribute to enhancement of the strength but bring an increase of the factor of bending deflection. However, it has been noted that these particles are effective for increasing a proportion of crystal particles having a {200} crystal plane parallel to the sheet surface in the solution treatment.

(iv) Ultra-coarse second phase particles: Particles having a particle diameter exceeding 3.0 μm and formed at the time of solidification in a casting step. These particles do not contribute to enhancement of the strength. When the particles remain in the product, they are liable to become the starting point of a crack at the time of bending work.

[Distribution of Second Phase Particles]

The "ultrafine second phase particles" having a particle diameter of 2 nm or more and less than 10 nm are important in obtaining high strength of 950 MPa or more in terms of a 0.2% yield strength. As a result of various investigations, it is necessary for the ultrafine second phase particles to ensure a number density of $1.0\times10^9$ number/mm$^2$ or more. When the number density is less than the foregoing range, it is difficult to obtain the strength level such that the 0.2% yield strength is 950 MPa or more unless the rolling ratio in finish cold-rolling is made considerably high. When the finish cold-rolling ratio is in excess, a proportion of the {200} crystal plane orientation on the sheet surface is lowered, and an increase of the factor of bending deflection is brought. Though it is not needed to particularly specify an upper limit of the number density of the ultrafine second phase particles, the upper limit of the number density of the ultrafine second phase particles is in general not more than $5.0\times10^9$ number/mm$^2$ in a chemical composition range which is subjective in the present invention. In addition, the number density of the ultrafine second phase particles is preferably $1.5\times10^9$ number/mm$^2$ or more.

The "fine second phase particles" having a particle diameter of 10 nm or more and less than 100 nm do not substantially contribute to enhancement of the strength and also do not contribute to enhancement of the bending workability. In addition, the "fine second phase particles" having a particle diameter of 10 nm or more and less than 100 nm become a cause for increasing the factor of bending deflection. In consequence, a metal texture in which a proportion of existence of unnecessary fine second phase particles is low, and the amount of the ultrafine second phase particles effective for enhancing the strength is sufficiently ensured in proportion thereto as described above is subjective in the present invention. Specifically, the number density of the fine second phase particles is restricted to not more than $5.0\times10^7$ number/mm$^2$, and more preferably not more than $4.0\times10^7$ number/mm$^2$.

By allowing the "coarse second phase particles" having a particle diameter of 100 nm or more and not more than 3.0 μm to exist sufficiently at a stage of an intermediate product to be provided for the solution treatment, they exhibit an action to form a recrystallization texture ({200} orientation as described later) having a crystal orientation which is extremely advantageous for decreasing the factor of bending deflection at the time of solution treatment. However, when the amount of the coarse second phase particles is in excess, an increase of the factor of bending deflection is brought. In consequence, in the present invention, the number density of the coarse second phase particles is set to $1.0\times10^5$ number/mm$^2$ or more and not more than $1.0\times10^6$ number/mm$^2$. In the case where the number density of the coarse second phase particles is less than the foregoing range, the formation of a crystal orientation becomes insufficient, so that an effect for decreasing the factor of bending deflection is hardly obtained. In the case where the number density of the coarse second phase particles is more than the foregoing range, an increase of the factor of bending deflection is easily brought, and it becomes insufficient to ensure the amount of the ultrafine second phase particles, so that a lowering of the strength is easily brought. Incidentally, the number density of the coarse second phase particles is more preferably not more than $5.0\times10^5$ number/mm$^2$.

The "ultra-coarse second phase particles" having a particle diameter exceeding 3.0 μm are not beneficial in the present invention, and therefore, it is desirable that the amount of the ultra-coarse second phase particles is as small as possible. However, in the case where the ultra-coarse second phase particles exist in a large amount to an extent that the bending workability is impaired, in the first place, it is difficult to sufficiently ensure the amounts of existence of the ultrafine second phase particles and the coarse second phase particles as described above. In consequence, in the present invention, it is not needed to particularly specify the number density of the ultra-coarse second phase particles.

[Crystal Orientation]

In the sheet material of a copper material produced through rolling, the orientation of a crystal in which not only the {200} crystal plane is parallel to the sheet surface, but the <001> direction is parallel to the rolling direction is called cube orientation. The crystal of cube orientation exhibits equal deformation properties in three directions of sheet thickness direction (ND), rolling direction (RD), and vertical direction (TD) to the rolling direction and the sheet thickness direction. A slip line on the {200} crystal plane has high symmetry as 45° and 135° relative to the bending axis, and therefore, it is possible to effect bending deformation without forming a shear band. For that reason, the crystal grains of cube orientation essentially have satisfactory bending workability.

It is well known that the cube orientation is a major orientation of a pure copper-type recrystallization texture. However, in the copper alloy, it is difficult to develop the cube orientation under a general process condition. As a result of extensive and intensive investigations made by the present inventors, it has been found that by applying a step of combining hot-rolling and solution treatment under a specified condition (as described later), in the Cu—Ni—Co—Si based alloy, it is possible to realize a crystal texture in which a proportion of existence of crystal grains whose {200} crystal plane is substantially parallel to the sheet surface (this crystal texture will be sometimes referred to simply as "{200} orientation") is high. Then, it has been discovered that the Cu—Ni—Co—Si based copper alloy sheet material of {200} orientation is not only satisfactory in the bending workability but extremely effective for decreasing the factor of bending deflection.

Specifically, by forming a copper alloy sheet material having a crystal orientation satisfying the following equation (1), a low factor of bending deflection as not more than 95 GPa can be realized. It is much more effective to satisfy the following equation (1)'.

$$I\{200\}/I_0\{200\} \geq 3.0 \quad (1)$$

$$I\{200\}/I_0\{200\} \geq 3.5 \quad (1)'$$

Here, I{200} represents an integrated intensity of an X-ray diffraction peak of the {200} crystal plane on the copper alloy sheet material sheet surface; and $I_0\{200\}$ represents an integrated intensity of an X-ray diffraction peak of the {200} crystal plane in a pure copper standard powder.

Incidentally, with respect to the Cu—Ni—Co—Si based copper alloy sheet material of {200} orientation in which a factor of bending deflection of not more than 95 GPa is obtained, when an X-ray diffraction intensity of each of the {220} crystal plane and the {211} crystal plane on the sheet surface is measured, the following equations (2) and (3) are valid.

$$I\{220\}/I_0\{220\} \leq 3.0 \quad (2)$$

$$I\{211\}/I_0\{211\} \leq 3.5 \quad (3)$$

Here, I{220} represents an integrated intensity of an X-ray diffraction peak of the {220} crystal plane on the copper alloy sheet material sheet surface; and $I_0\{220\}$ represents an integrated intensity of an X-ray diffraction peak of the {200} crystal plane in a pure copper standard powder. Similarly, I{211} represents an integrated intensity of an X-ray diffraction peak of the {211} crystal plane on the copper alloy sheet material sheet surface; and $I_0\{211\}$ represents an integrated intensity of an X-ray diffraction peak of the {211} crystal plane in a pure copper standard powder.

[Chemical Composition]

The component elements of the Cu—Ni—Co—Si based alloy which is subjective in the present invention are described. Hereinafter, the term "%" regarding the alloy element means "% by mass" unless otherwise indicated.

Ni is an element that forms a Ni—Si based precipitate to enhance the strength and electrical conductivity of the copper alloy sheet material. In order to sufficiently exhibit its action, it is necessary to regulate the Ni content to 0.80% or more, and it is more effective to regulate the Ni content to 1.30% or more. On the other hand, the excess of the Ni content becomes a cause to bring a lowering of the electrical conductivity or a crack at the time of bending work due to the formation of a coarse precipitate. As a result of various investigations, the Ni content is restricted to the range of not more than 3.50%, and it may also be controlled to not more than 3.00%.

Co is an element that forms a Co—Si based precipitate to enhance the strength and electrical conductivity of the copper alloy sheet material. In addition, Co has an action to disperse a Ni—Si based precipitate. The strength is much more enhanced by a synergistic effect to be brought due to the copresence of two kinds of the precipitates. In order to sufficiently exhibit these actions, it is preferable to ensure the Co content of 0.50% or more. However, in view of the fact that Co is a metal having a higher melting point than Ni, when the Co content is too high, it is difficult to achieve perfect solid solution by the solution treatment, and undissolved Co is not used for the formation of a Co—Si based precipitate which is effective for enhancing the strength. For that reason, the Co content is preferably not more than 2.00%, and more preferably not more than 1.80%.

Si is an element which is necessary for the formation of a Ni—Si based precipitate and a Co—Si based precipitate. The Ni—Si based precipitate is considered to be a compound composed mainly of $Ni_2Si$, and the Co—Si based precipitate is considered to be a compound composed mainly of $Co_2Si$. However, all of Ni, Co and Si in the alloy do not always become precipitates by the aging treatment but exist in a solid solution state in the matrix to some extent. Though Ni, Co and Si in the solid solution state slightly enhance the strength of the copper alloy, an effect thereof is small as compared with that in the precipitated state, and a lowering of the electrical conductivity is caused. For that reason, it is preferable to make the Si content as close as possible to a composition ratio of each of the precipitates $Ni_2Si$ and $Co_2Si$. For that reason, it is preferable to regulate a mass ratio of (Ni+Co)/Si to from 3.0 to 6.0, and it is more effective to regulate the mass ratio of (Ni+Co)/Si to from 3.5 to 5.0. From such a viewpoint, in the present invention, an alloy having an Si content in the range of from 0.30 to 2.00% is subjective, and an alloy having a Si content in the range of from 0.50 to 1.20% is more preferable.

As arbitrary additive elements other than those as described above, Fe, Cr, Mg, Mn, Ti, V, Zr, Sn, Zn, Al, B, P, Ag, Be, REM (rare earth element), and the like may be added, if desired. For example, Sn has an action to enhance stress relaxation resistance; Zn has an action to improve soldering properties and casting properties of the copper alloy sheet material; and Mg has an action to enhance stress relaxation resistance, too. Fe, Cr, Mn, Ti, V, Zr, and the like have an action to enhance the strength. Ag is effective in contemplating solute strengthening without largely lowering the electrical conductivity. P has a deoxidizing action, and B has an action to make the casting texture finer; and both of them are effective for enhancing the hot workability. In addition, REM (rare earth element) such as Ce, La, Dy, Nd, and Y is effective for making the crystal grains finer or dispersing the precipitate.

When a large amount of such an arbitrary additive element is added, some element forms a compound with Ni, Co and Si, so that it becomes difficult to satisfy a relation between size and distribution of the second phase particles as specified in the present invention. In addition, there may be the case where the electrical conductivity is lowered, or the hot workability or cold workability is adversely affected. As a result of various investigations, it is desirable to regulate the content of each of these elements to the following range: from 0 to 0.10% for Fe, from 0 to 0.10% for Cr, from 0 to 0.10% for Mg, from 0 to 0.10% for Mn, from 0 to 0.30%, and preferably from 0 to 0.25% for Ti, from 0 to 0.20% for V, from 0 to 0.15% for Zr, from 0 to 0.10% for Sn, from 0 to 0.15% for Zn, from 0 to 0.20% for Al, from 0 to 0.02% for B, from 0 to 0.10% for P, from 0 to 0.10% for Ag, from 0 to 0.15% for Be, and from 0 to 0.10% for REM (rare earth element). In addition, the total amount of these arbitrary additive elements is preferably not more than 2.0%, and it may also be controlled to not more than 1.0% or not more than 0.5%.

[Properties]

For base materials which are applied to electrical or electronic parts such as connectors, in a terminal portion (inserting portion) of the part, they are required to have strength such that buckling or deformation to be brought due to a stress load at the time of insertion is not generated. In particular, in order to respond to downsizing and thinning of the part, the requirements for the strength level become much stricter. When needs for downsizing and thinning in the future are taken into consideration, it is desirable to regulate the 0.2% yield strength in the rolling direction to 950 MPa or more in terms of the strength level of the copper alloy sheet material as a base material. In general, the 0.2% yield strength in the rolling direction may be regulated to the range of 950 MPa or more and less than 1,000 MPa, and it may also be controlled to 950 MPa or more and less than 990 MPa, or 950 MPa or more and less than 980 MPa.

On the other hand, in order to respond to a need to attach importance to an "inserting feeling" of a terminal portion in practical use, it is extremely effective to make the factor of bending deflection small such that elastic displacement as a spring becomes large. For that reason, in the sheet material having the above-described high strength, the factor of bending deflection is desirably small as not more than 95 GPa, and more preferably not more than 90 MPa.

In addition, in electric current conduction parts such as connectors, for the purpose of responding to higher integration, higher-density mounting, and larger current of electrical or electronic parts, a requirement for higher electrical conductivity is even more increasing than before. Specifically, an electrical conductivity of 30% IACS or more is desirable, and it is more preferable to ensure an electrical conductivity of 35% IACS or more.

[Production Method]

The above-described copper alloy sheet material can be produced through a process of "hot-rolling→cold-rolling→solution treatment→aging treatment". However, in the hot-rolling and the solution treatment, a device is required for the production condition. In the cold-rolling which is conducted between the hot-rolling and the solution treatment, intermediate annealing controlled to a prescribed condition may be applied. After the aging treatment, "finish cold-rolling" can be conducted. In addition, thereafter, "low temperature annealing" can be applied. As a series of process, there can be exemplified a process of "melting and casting→hot-rolling→cold-rolling→solution treatment→aging treatment→finish cold-rolling→low temperature annealing". A production condition of each of the steps is hereunder exemplified.

[Melting and Casting]

An ingot can be produced by melting raw materials of a copper alloy and subsequently conducting continuous casting or semi-continuous casting or the like in the same method as a general melting method of copper alloy. In order to prevent oxidation of Co and Si from occurring, it is desirable to coat a molten metal with charcoal, carbon, or the like, or to conduct melting within a chamber in an inert gas atmosphere or under vacuum. Incidentally, after casting, the ingot can be provided for homogenization annealing depending upon the state of cast texture, if desired. The homogenization annealing may be, for example, conducted under a heating condition at from 1,000 to 1,060° C. for from 1 to 10 hours. The homogenization annealing may be conducted as a heating step in hot-rolling which is a subsequent step.

[Hot-Rolling]

In view of obtaining a "copper alloy sheet material intermediate product" to be provided for a solution treatment as described later, it is extremely effective that after heating the ingot at from 1,000 to 1,060° C., not only rolling at a rolling ratio of 85% or more (the rolling ratio is preferably from 85 to 95%) is carried out in a temperature range of not higher than 1,060° C. and 850° C. or higher, but rolling at a rolling ratio of 30% or more is carried out in a temperature range of lower than 850° C. and 700° C. or higher.

In the course of solidification at the time of casting, coarse crystallized products having a particle diameter exceeding 3.0 μm are inevitably formed, and in the course of cooling thereof, coarse precipitates having a particle diameter exceeding 3 μm are inevitably formed. Those crystallized products and precipitates are included as the ultra-coarse second phase particles in the ingot. By applying rolling work at a rolling ratio of 85% or more in a high temperature region of 850° C. or higher, the formation of solid solution is promoted while decomposing the above-described ultra-coarse second phase particles, thereby contemplating to achieve homogenization of the texture. When the rolling ratio in this high temperature region is less than 85%, the solid solution of the ultra-coarse second phase particles becomes insufficient, and the residual ultra-coarse second phase particles remain even in the subsequent step without being solid-solved. Therefore, the precipitation amount of the ultrafine second phase particles is decreased in the aging treatment, resulting in a lowering of the strength. In addition, since the residual particles having a particle diameter exceeding 3.0 μm become the starting point of a crack at the time of bending work, there is a concern that the bending workability is deteriorated.

Subsequently, the rolling ratio of 30% in a temperature region of lower than 850° C. and 700° C. or higher is ensured. According to this, the precipitation is promoted, and in a "copper alloy sheet material intermediate product" to be provided for a solution treatment, it is possible to ensure the number density of the coarse second phase particles having a particle diameter of 100 nm or more and not more than 3.0 μm within the above-described prescribed range. In this way, by controlling the number density of the coarse second phase particles in the hot-rolling step, it becomes possible to obtain a {200} orientation in the solution treatment. In addition, by adopting the above-described heat treatment condition, it is also possible to allow the number density of the fine second phase particles having a particle diameter of 10 nm or more and less than 100 nm to not exceed the above-described prescribed amount in the copper alloy sheet material intermediate product. When the rolling ratio in a temperature region of lower than 850° C. and 700° C. or higher is less than 30%, precipitation of the second phase particles and particle growth into the coarse second phase particles become insufficient. In that case, the number density of the fine second phase particles having a particle diameter of 10 nm or more and less than 100 nm which do not contribute to both enhancement of the strength and formation of the {200} orientation increases, thereby easily bringing a lowering of the strength, an increase of the factor of bending deflection, and deterioration of the bending workability. In addition, when the rolling ratio in a temperature region of lower than 850° C. and 700° C. or higher is insufficient, an increase of the fine second phase particles is easily brought, thereby possibly becoming a cause of increasing the factor of bending deflection. Incidentally, the rolling ratio in this temperature region is more preferably not more than 60%.

Incidentally, the rolling ratio is represented by the following equation (4).

$$\text{Rolling ratio } R\ (\%)=(h_0-h_1)/h_0\times 100 \quad (4)$$

Here, $h_0$ represents a sheet thickness (mm) before rolling, and $h_1$ represents a sheet thickness (mm) after rolling.

A total rolling ratio in hot-rolling may be from 85 to 98%.

As an example, the case where an ingot having a thickness of 100 mm is subjected to rolling at a rolling ratio of 90% in a high temperature region of 850° C. or higher and to rolling at a rolling ratio of 40% in a temperature region of lower than 850° C. is described. First of all, with respect to the rolling at a rolling ratio of 90%, in the equation (4), when 100 mm is substituted for $h_0$, and 90% is substituted for R, the sheet thickness $h_1$ after rolling becomes 10 mm. Next, with respect to the rolling at a rolling ratio of 40%, in the equation (4), when 10 mm is substituted for $h_0$, and 40% is substituted for R, the sheet thickness $h_1$ after rolling becomes 6 mm. In consequence, in that case, in the hot-rolling, the initial sheet thickness is 100 mm, and the final sheet thickness is 6 mm, and therefore, when in the equation (4), 100 mm and 6 mm are again substituted for $h_0$ and $h_1$, respectively, a total rolling ratio in the hot-rolling becomes 94%.

After completion of the hot-rolling, it is preferable to conduct rapid cooling by means of water cooling or the like. In addition, after the hot-rolling, surface grinding or acid pickling can be conducted, if desired.

[Cold-Rolling]

For the purpose of obtaining a prescribed thickness, by applying cold-rolling to a hot-rolled material in which a particle size of the second phase particles has been adjusted by the above-described hot-rolling, a "copper alloy sheet material intermediate product" to be provided for a solution treatment can be prepared. Intermediate annealing may be applied on the way of the cold-rolling step, if desired. Though the coarse second phase particles are slightly stretched in the rolling direction by the cold-rolling, in the case of not applying the intermediate annealing, the volume of the second phase particles is kept. When the intermediate annealing is applied, precipitation of the second phase is generated. However, there is no problem so long as the annealing is conducted under a condition under which the number density of the fine second phase particles having a particle diameter of 10 nm or more and less than 100 nm is kept in the range of not more than $5.0\times10^7$ number/mm$^2$. In the present invention, a value measured through observation with a scanning electron microscope (SEM) regarding a cross section parallel to the sheet surface is adopted as the number density of the coarse second phase particles as described later. However, according to investigations made by the present inventors, it has been noted that by applying a solution treatment having a peculiar heat pattern as described later to a copper alloy sheet material intermediate product having a number density of the coarse second phase particles having a particle diameter of 100 nm or more and not more than 3.0 μm as determined by that method of $1.0\times10^5$ number/mm$^2$ or more and not more than $1.0\times10^6$ number/mm$^2$, a desired crystal orientation is obtained. It is possible to allow the number density of the "coarse second phase particles" after this cold-rolling to fall within the foregoing range in the condition range of hot-rolling as described above. Here, the cold-rolling may be in general made within the rage where the rolling ratio is not more than 99%. Incidentally, the cold-rolling may not be carried out so long as the sheet thickness reaches the desired range in the hot-rolling. However, from the viewpoint of promoting recrystallization in the solution treatment, is advantageous to apply cold-rolling at a rolling ratio of 50% or more. In the case of not applying the intermediate annealing, the solution treatment step becomes a first heat treatment after the hot-rolling.

[Solution Treatment]

A solution treatment is applied to the copper alloy sheet material intermediate product in which the number density of the "coarse second phase particles" having a particle diameter of 100 nm or more and not more than 3.0 μm is adjusted as described above. In general, a main object of the solution treatment is to dissolve solute elements again in a matrix and to achieve sufficient recrystallization. In the present invention, it is further an important object to obtain a recrystallization texture of {200} orientation.

In the solution treatment according to the present invention, it is important to raise the temperature to 950° C. or higher in the course of temperature rising such that a temperature rise rate of from 800° C. to 950° C. is 50° C./sec or more. When such rapid temperature rising is applied to the Cu—Ni—Co—Si based copper alloy sheet material in which the number density of the "coarse second phase particles" having a particle diameter of 100 nm or more and not more than 3.0 μm is adjusted as described above, the {200} orientation increases, and a low crystal orientation in which a sheet surface X-ray diffraction intensity of each of the {220} plane and the {211} plane is low can be obtained. Though at present, there are a lot of unclear points regarding the mechanism in which such a crystal orientation is obtained, it may be considered that the coarse second phase particles having the above-described particle diameter have an action to suppress the crystal grain growth due to recrystallization. In the case where such particles are dispersed in an appropriate amount, when recrystallization is abruptly caused due to rapid temperature rising, the crystal growth does not become excessive, resulting in obtaining the {200} orientation. When the temperature rise rate of from 800° C. to 950° C. is slower than 50° C./sec, an advance rate of the recrystallization becomes slow, so that it is difficult to stably obtain the {200} orientation.

By heating and holding at 950° C. or higher, re-dissolution of the solute elements is sufficiently advanced. When the holding temperature is lower than 950° C., re-dissolution and recrystallization are liable to become insufficient. On the other hand, when the holding temperature exceeds 1,020° C., coarsening of the crystal grains is liable to be brought. In all of these cases, it becomes finally difficult to obtain a high strength material having excellent bending workability. In consequence, the holding temperature is set to from 950 to 1,020° C. A holding time in this temperature region may be, for example, from 5 seconds to 5 minutes. As for cooling after holding, in order to prevent precipitation of the solid-solved second phase particles from occurring, it is preferable to conduct rapid cooling. According to the solution treatment having such a heat pattern, the sheet material having a {200} orientation satisfying the foregoing equation (1), preferably the foregoing equation (1)' is obtained.

[Aging Treatment]

A main object of the aging treatment is to enhance the strength and electrical conductivity. It is necessary to prevent coarsening of the second phase particles from occurring while precipitating the ultrafine second phase particles contributing to the strength in an amount as large as possible. When the aging treatment temperature is excessively high, the precipitate is liable to be coarsened, and coarsening of the ultrafine second phase particles brings a lowering of the strength and an increase of the factor of bending deflection. On the other hand, when the aging treatment is too low, an effect for improving the properties as described above is not sufficiently obtained, or the aging time is too long, resulting in a disadvantage in view of productivity. Specifically, the aging treatment is preferably conducted in a temperature range of from 350 to 500° C. As for the aging treatment time, as usually carried out, when it is from approximately 1 to 10 hours at which the hardness becomes a peak (maximum), satisfactory results are obtained.

[Finish Cold-Rolling]

In this finish cold-rolling, it is contemplated to more enhance the strength level. However, the rolled texture with a {220} orientation as a main orientation component develops with an increase of the cold-rolling ratio. When the rolling ratio is too high, the rolled texture with a {220} orientation becomes relatively excessively predominant, so that it becomes difficult to make both high strength and low factor of bending deflection compatible with each other. In consequence, it is necessary to carry out the finish cold-rolling within a range of rolling ratio in which the crystal orientation satisfying the foregoing equation (1), more preferably the foregoing equation (1)' is kept. As a result of detailed investigations made by the present inventors, it is desirable to conduct the finish cold-rolling within a range in which the rolling ratio does not exceed 60%, and it is more preferable to conduct the finish cold-rolling within a range in which the rolling ratio is not more than 50%.

[Low Temperature Annealing]

For the purposes of decreasing a residual stress and enhancing a spring deflection limit and stress relaxation resistance properties in the copper alloy sheet material, low temperature annealing may be applied after the finish cold-rolling. The heating temperature is set to the range of preferably from 150 to 550° C., and more preferably from 300 to 500° C. According to this, the residual stress in the inside of the sheet material is decreased, and the bending workability can be enhanced without being substantially accompanied by a lowering of the strength. In addition, an effect for enhancing the electrical conductivity is also brought. When this heating temperature is too high, the resulting copper alloy sheet material is softened within a short time, so that scatterings in the properties are easily generated in even either a batch system or a continuous system. On the other hand, when the heating temperature is too low, the above-described effect for improving the properties is not sufficiently obtained. The heating time can be set within the range of 5 seconds or more. It is more preferable to set the heating time within the range of from 30 seconds to 1 hour.

EXAMPLES

A copper alloy having a chemical composition shown in Table 1 was melted in a high-frequency melting furnace to obtain an ingot having a thickness of 60 mm. Each ingot was subjected to homogenization annealing at 1,030° C. for 4 hours. Thereafter, a copper alloy sheet material (specimen under test) having a sheet thickness of 0.15 mm through steps of hot-rolling→cold-rolling→solution treatment aging treatment→finish cold-rolling→low temperature annealing.

The hot rolling was conducted by a method in which the ingot was heated at 1,000° C., rolled at a rolling ratio of every sort and kind in a high temperature region of from 1,000° C. to 850° C., and subsequently rolled at a rolling ratio of every sort and kind in a temperature region of from lower than 850° C. to 700° C. The rolling ratio in each of the temperature regions is shown in Table 1. The final pass temperature was 700° C. or higher, and after the hot-rolling, the material was rapidly cooled by means of water cooling. The surface oxide layer of the obtained hot-rolled material was removed by means of mechanical polishing, followed by applying cold-rolling to obtain a "copper alloy sheet material intermediate product" having a sheet thickness of 0.20 mm.

The above-described copper alloy sheet material intermediate product was subjected to a solution treatment. At the time of temperature rise, the temperature rise rate was variously changed of from 800 to 950° C., and the temperature was raised to a holding temperature of 1,000° C. The temperature rise rate at from 800 to 950° C. was measured using a thermocouple equipped on the sample surface. After the temperature reached 1,000° C., the sample was held for 1 minute and thereafter, subjected to rapid cooling (water cooling) to ambient temperature at a cooling rate of 50° C./sec or more. The temperature rise rate of from 800 to 950° C. is shown in Table 1.

The aging treatment temperature was set to 430° C., and the aging time was adjusted to a time at which the hardness became a peak by aging at 430° C. depending upon the alloy composition. However, in Comparative Example No. 38, the aging treatment temperature was set to 530° C., and the aging time was adjusted to a time at which the hardness became a peak by aging at 530° C. After the aging treatment, the sample was subjected to finish rolling to have a sheet thickness to 0.15 mm and finally subjected to low temperature annealing at 425° C. for 1 minute, thereby obtaining a specimen under test.

Incidentally, in Comparative Example No. 37, the hot-rolled material was subjected to mechanical polishing and then subjected to intermediate annealing at 550° C. for 6 hours. After the intermediate annealing, cold-rolling was applied, thereby preparing a "copper alloy sheet material intermediate product" having a sheet thickness of 0.20 mm. Thereafter, a solution treatment, an aging treatment, finish rolling, and low temperature annealing were successively applied under the same conditions as those in the Examples according to the present invention, thereby preparing a copper alloy sheet material (specimen under test) having a sheet thickness of 0.15 mm.

TABLE 1

| | | Chemical composition (% by mass) | | | | | Hot-rolling | | Solution treatment |
|---|---|---|---|---|---|---|---|---|---|
| | | | | | | | Rolling ratio at 850° C. or higher | Rolling ratio at lower than 850° C. | Temperature rise rate of from 800 to 950° C. |
| | No. | Cu | Ni | Co | Si | Others | (%) | (%) | (° C./sec) |
| Example according to | 1 | Balance | 2.48 | 1.33 | 0.87 | — | 89 | 37 | 62 |
| | 2 | Balance | 2.64 | 1.25 | 0.92 | V: 0.15 | 86 | 49 | 60 |

TABLE 1-continued

| | | Chemical composition (% by mass) | | | | | Hot-rolling: Rolling ratio at 850° C. or higher (%) | Hot-rolling: Rolling ratio at lower than 850° C. (%) | Solution treatment: Temperature rise rate of from 800 to 950° C. (° C./sec) |
|---|---|---|---|---|---|---|---|---|---|
| | No. | Cu | Ni | Co | Si | Others | | | |
| the present invention | 3 | Balance | 2.33 | 1.41 | 0.80 | Fe: 0.07, Zn: 0.13 | 89 | 38 | 61 |
| | 4 | Balance | 2.05 | 1.15 | 0.64 | REM: 0.06 | 90 | 31 | 55 |
| | 5 | Balance | 2.81 | 1.13 | 0.95 | Ti: 0.24, Sn: 0.06 | 87 | 44 | 63 |
| | 6 | Balance | 1.35 | 1.80 | 0.71 | Mn: 0.07 | 89 | 38 | 62 |
| | 7 | Balance | 1.81 | 1.60 | 0.81 | Al: 0.16, Ag: 0.06 | 90 | 33 | 60 |
| | 8 | Balance | 2.22 | 1.50 | 0.83 | Mg: 0.07 | 89 | 36 | 54 |
| | 9 | Balance | 2.40 | 1.44 | 0.84 | — | 86 | 49 | 55 |
| | 10 | Balance | 1.94 | 1.25 | 0.75 | — | 88 | 43 | 60 |
| | 11 | Balance | 3.42 | 0.52 | 0.91 | — | 89 | 38 | 53 |
| | 12 | Balance | 2.35 | 1.55 | 0.97 | B: 0.003, Cr: 0.07 | 89 | 35 | 62 |
| | 13 | Balance | 2.39 | 1.21 | 0.81 | — | 89 | 37 | 60 |
| | 14 | Balance | 2.21 | 1.40 | 0.83 | Zr: 0,12, P: 0.06 | 87 | 45 | 61 |
| | 15 | Balance | 2.61 | 1.27 | 0.90 | Be: 0.12 | 88 | 44 | 57 |
| | 16 | Balance | 3.10 | 1.43 | 1.19 | — | 87 | 46 | 59 |
| Comparative Example | 31 | Balance | 2.48 | 1.33 | 0.87 | — | 89 | 37 | 30 |
| | 32 | Balance | 2.40 | 1.44 | 0.84 | — | 86 | 49 | 15 |
| | 33 | Balance | 2.22 | 1.50 | 0.83 | Mg: 0.04 | 90 | 20 | 55 |
| | 34 | Balance | 2.22 | 1.50 | 0.83 | Mg: 0.04 | 93 | 0 | 53 |
| | 35 | Balance | 2.22 | 1.50 | 0.83 | Mg: 0.04 | 70 | 56 | 54 |
| | 36 | Balance | 2.20 | 1.50 | 0.83 | Mg: 0.04 | 50 | 85 | 56 |
| | 37 | Balance | 2.31 | 1.45 | 0.85 | — | 89 | 39 | 60 |
| | 38 | Balance | 2.38 | 1.37 | 0.82 | — | 88 | 43 | 59 |
| | 39 | Balance | 2.39 | 1.21 | 0.81 | Cr: 0.34 | 90 | 33 | 61 |

Underlined: Outside the scope of the present invention

[Number Density of Second Phase Particles]

With respect to each of the specimens under test, the number density of each of the "ultrafine second phase particles" having a particle diameter of 2 nm or more and less than 10 nm, the "fine second phase particles" having a particle diameter of 10 nm or more and less than 100 nm, and the "coarse second phase particles" having a particle diameter of 100 nm or more and not more than 3.0 μm was measured.

With respect to each of the ultrafine second phase particles and the fine second phase particles, 10 fields of vision obtained by selecting a photograph with 100,000 magnifications by a transmission electron microscope (TEM) at random were photographed, and the number of particles corresponding to the ultrafine second phase particles or the fine second phase particles was counted on the photograph, thereby calculating the number density.

With respect to the coarse second phase particles, 10 fields of vision obtained by observing an electrolytically polished surface parallel to the sheet surface by a scanning electron microscope (SEM) and selecting a photograph with 3,000 magnifications at random were photographed, and the number of particles corresponding to the coarse second phase particles was counted on the photograph, thereby calculating the number density. For the electrolytic polishing, a mixed solution of phosphoric acid, ethanol, and pure water was used.

In all of these cases, a diameter of a minimum circle surrounding each particle was defined as the particle diameter.

Incidentally, with respect to the coarse second phase particles and the fine second phase particles, the number density of the above-described copper alloy sheet material intermediate product was confirmed.

In addition, a sample was collected from each of the specimens under test and measured for X-ray diffraction intensity, 0.2% yield strength, factor of bending deflection, electrical conductivity, and bending workability in the following manners.

[X-Ray Diffraction Intensity]

With respect to the sheet surface (rolled surface) of the sample, an integrated intensity I{200} of a diffraction peak of the {200} plane, an integrated intensity I{220} of a diffraction peak of the {220} plane, and an integrated intensity I{211} of a diffraction peak of the {211} plane were measured, and with respect to a pure copper standard powder, an integrated intensity $I_0${200} of a diffraction peak of the {200} plane, an integrated intensity $I_0${220} of a diffraction peak of the {220} plane, and an integrated intensity $I_0${211} of a diffraction peak of the {211} plane were measured, by using an X-ray diffraction apparatus under conditions of Mo—K$\alpha_1$ and K$\alpha_2$ rays, a tube voltage of 40 kV, and a tube current of 30 mA. Incidentally, in the case where distinct oxidation was observed on the rolled surface of the sample, a sample treated by acid pickling or polishing with a #1500 waterproof paper was used. Incidentally, a commercially available copper powder having a size of 325 mesh (JIS Z8801) and having a purity of 99.5% was used as the pure copper standard powder.

[0.2% Yield Strength]

Each three test pieces for tensile test (No. 5 test pieces in conformity with JIS ZJ2241) of the copper alloy sheet material (specimen under test) parallel to the rolling direction were collected and subjected to a tensile test in conformity with JIS ZJ2241, and the 0.2% yield strength was determined from an average value thereof.

[Factor of Bending Deflection]

The factor of bending deflection was measured in conformity with the Japan Copper and Brass Association (JCBA) Technical Standard (T312). The width of the test piece was set to 10 mm, and the length thereof was set to 15 mm. A bending test of a cantilever beam was carried out, and the factor of bending deflection was measured from the load and the deflection displacement.

[Electrical Conductivity]

The electrical conductivity was measured in conformity with JIS H0505.

[Bending Workability]

A bending test piece (width: 1.0 mm, length: 30 mm) in which the longitudinal direction was TD (perpendicular to the rolling direction) was collected from the copper alloy sheet material (specimen under test) and subjected to a 90° W bending test in conformity with JIS H3110. With respect to the test piece after this test, the surface of the bending worked portion was observed at a magnification of 100 times by an optical microscope; a minimum bending radius R at which a crack was not generated was determined; and this minimum bending radius R was divided by a sheet thickness t of the copper alloy sheet material, thereby determining an R/t value of TD. It can be decided that materials in which this R/t value is not more than 1.0 have sufficient bending workability in working into electrical or electronic parts such as connectors.

The foregoing results are shown in Table 2.

TABLE 2

| | No. | Number density of second phase particles: Ultrafine (2 nm or more and less than 10 nm) ($\times 10^9$ number/mm$^2$) | Fine (10 nm or more and less than 100 nm) ($\times 10^7$ number/mm$^2$) | Coarse (100 nm or more and not more than 3 μm) ($\times 10^5$ number/mm$^2$) | X-Ray diffraction intensity ratio: I{200}/I$_0$\{200\} | I{220}/I$_0$\{220\} | I{211}/I$_0$\{211\} | Electrical conductivity (% IACS) | 0.2% Yield strength (MPa) | Bending workability R/t | Factor of bending deflection (GPa) |
|---|---|---|---|---|---|---|---|---|---|---|---|
| Example according to the present invention | 1 | 2.1 | 1.4 | 2.1 | 4.1 | 1.6 | 1.2 | 40 | 954 | 0.0 | 89 |
| | 2 | 2.0 | 1.1 | 2.3 | 4.3 | 1.2 | 0.8 | 40 | 968 | 0.0 | 87 |
| | 3 | 1.7 | 1.6 | 2.5 | 3.8 | 2.1 | 1.4 | 39 | 958 | 0.0 | 91 |
| | 4 | 2.9 | 2.3 | 1.2 | 3.5 | 2.3 | 1.6 | 36 | 952 | 0.0 | 91 |
| | 5 | 1.8 | 2.3 | 2.5 | 3.4 | 2.0 | 1.3 | 37 | 965 | 0.7 | 94 |
| | 6 | 1.7 | 1.4 | 1.4 | 4.1 | 1.7 | 1.0 | 43 | 951 | 0.0 | 89 |
| | 7 | 2.5 | 2.5 | 2.0 | 4.2 | 1.7 | 1.1 | 40 | 962 | 0.0 | 86 |
| | 8 | 2.0 | 1.6 | 2.1 | 3.8 | 2.1 | 1.5 | 38 | 967 | 0.3 | 92 |
| | 9 | 2.2 | 1.1 | 1.9 | 3.7 | 1.9 | 1.2 | 38 | 958 | 0.0 | 91 |
| | 10 | 2.1 | 2.3 | 1.4 | 3.6 | 2.3 | 1.4 | 42 | 965 | 0.7 | 90 |
| | 11 | 2.9 | 2.5 | 2.5 | 3.4 | 2.2 | 1.6 | 35 | 973 | 0.7 | 93 |
| | 12 | 3.1 | 2.0 | 2.4 | 3.9 | 1.7 | 1.3 | 36 | 964 | 0.3 | 91 |
| | 13 | 2.4 | 1.4 | 2.0 | 4.2 | 1.4 | 0.8 | 41 | 961 | 0.0 | 88 |
| | 14 | 1.9 | 1.6 | 1.9 | 3.9 | 1.9 | 1.0 | 41 | 954 | 0.0 | 91 |
| | 15 | 2.2 | 2.3 | 2.5 | 3.7 | 2.0 | 1.3 | 39 | 963 | 0.3 | 92 |
| | 16 | 2.8 | 2.7 | 2.5 | 3.1 | 2.2 | 1.8 | 35 | 970 | 0.7 | 94 |
| Comparative Example | 31 | 2.1 | 1.4 | 2.1 | 2.1 | 3.3 | 2.3 | 40 | 965 | 1.7 | 106 |
| | 32 | 2.2 | 1.1 | 1.9 | 1.9 | 3.3 | 2.5 | 38 | 972 | 2.0 | 109 |
| | 33 | 2.4 | 7.1 | 0.74 | 1.6 | 3.5 | 2.5 | 38 | 952 | 2.0 | 107 |
| | 34 | 3.4 | 9.1 | 0.41 | 1.2 | 3.8 | 2.8 | 37 | 964 | 2.3 | 111 |
| | 35 | 0.80 | 3.4 | 2.2 | 3.5 | 1.7 | 1.3 | 38 | 920 | 0.3 | 93 |
| | 36 | 0.67 | 2.0 | 4.1 | 3.2 | 2.2 | 1.5 | 37 | 880 | 0.3 | 91 |
| | 37 | 1.3 | 6.8 | 5.8 | 3.1 | 2.4 | 2.0 | 39 | 954 | 0.3 | 108 |
| | 38 | 1.1 | 2.0 | 13.0 | 3.4 | 1.9 | 1.4 | 41 | 951 | 0.7 | 98 |
| | 39 | 0.86 | 4.5 | 13.4 | 3.2 | 1.8 | 1.1 | 42 | 925 | 0.7 | 104 |

Underlined: Outside the scope of the present invention

As is clear from Table 2, all of the Examples according to the present invention in which the number density of second phase particles and the and the crystal orientation fell within appropriate ranges had properties of an electrical conductivity of 30% IACS or more, a 0.2% yield strength of 950 MPa or more, and a factor of bending deflection of not more than 95 GPa and were satisfactory in bending workability. In these examples according to the present invention, it was confirmed that at the stage of the "copper alloy sheet material intermediate product" which was provided for the solution treatment, the number density of the "coarse second phase particles" having a particle diameter of 100 nm or more and not more than 3.0 μm already fell within the range of $1.0\times10^5$ number/mm$^2$ or more and not more than $1.0\times10^6$ number/mm$^2$, and the number density of the "fine second phase particles" having a particle density of 10 nm or more and less than 100 nm already fell within the range of not more than $5.0\times10^7$ number/mm$^2$. It may be considered that proper existence of the coarse second phase particles at this stage contributed to the formation of a {200} orientation satisfying the equation (1) in the solution treatment.

On the other hand, Comparative Example Nos. 31 and 32 are alloys having the same compositions as those of Nos. 1 and 8, respectively, and the number density of the coarse second phase particles fell within the range of $1.0\times10^5$ number/mm$^2$ or more and not more than $1.0\times10^6$ number/mm$^2$. However, in these Comparative Example Nos. 31 and 32, the temperature rise rate of from 800 to 950° C. in the solution treatment was too slow, so that the {200} orientation satisfying the equation (1) was not obtained, and the factor of bending deflection was inferior. Incidentally, with respect to of these Comparative Example Nos. 31 and 32, in the "copper alloy sheet material intermediate product" which was provided for the solution treatment, it was confirmed that the number density of the "coarse second phase particles" having a particle diameter of 100 nm or more and not more than 3.0 μm fell within the range of $1.0\times10^5$ number/mm$^2$ or more and not more than $1.0\times10^6$ number/mm$^2$, and the number density of the "fine second phase particles" having a particle density of 10 nm or more and less than 100 nm fell within the range of not more than $5.0\times10^7$ number/mm$^2$.

All of Comparative Example Nos. 33 and 34 are alloys having the same composition as that of No. 8. However, in the hot-rolling, the rolling ratio in a temperature region of lower than 850° C. was too low, or rolling in this temperature region was not applied, and therefore, in the copper alloy sheet material intermediate product to be provided for the solution treatment, the number density of the coarse second phase particles did not reach $1.0\times10^5$ number/mm$^2$. As a result, the {200} orientation satisfying the equation (1) was not obtained, and the factor of bending deflection was inferior. Incidentally, with respect to of these Comparative Example Nos. 33 and 34, in the "copper alloy sheet material intermediate product" which was provided for the solution treatment, it was confirmed that the number density of the fine second phase particles exceeded $5.0\times10^7$ number/mm$^2$.

Comparative Example Nos. 35 and 35 are alloys having the same composition as that of No. 8, too. However, in the hot-rolling, the rolling ratio in a high temperature region of 850° C. or higher was insufficient, and therefore, the solid solution of the ultra-coarse second phase particles became insufficient. As a result, the precipitation amount of the ultrafine second phase particles was decreased in the aging treatment, resulting in a lowering of the strength. Incidentally, with respect to of these Comparative Example Nos. 35 and 36, in the "copper alloy sheet material intermediate product" which was provided for the solution treatment, it was confirmed that the number density of the coarse second phase particles fell within the range of $1.0\times10^5$ number/mm$^2$ or more and not more than $1.0\times10^6$ number/mm$^2$, and the number density of the fine second phase particles fell within the range of not more than $5.0\times10^7$ number/mm$^2$.

Comparative Example No. 37 is an alloy produced through the steps in which an intermediate annealing step (recrystallization annealing at 550° C.) was added between the hot-rolling step and the solution treatment step. In the Comparative Example No. 37, though the bending workability and the strength level were relatively good, it may be considered that the number density of the "fine second phase particles" having a particle diameter of 10 nm or more and less than 100 nm became a value exceeding $5.0\times10^7$ number/mm$^2$ due to the fact that the intermediate annealing was applied, so that the factor of bending deflection was not sufficiently lowered. Incidentally, with respect to of the Comparative Example No. 37, in the "copper alloy sheet material intermediate product" which was provided for the solution treatment, it was confirmed that the number density of the coarse second phase particles fell within the range of $1.0\times10^5$ number/mm$^2$ or more and not more than $1.0\times10^6$ number/mm$^2$, and the number density of the fine second phase particles exceeded $5.0\times10^7$ number/mm$^2$.

Comparative Example No. 38 is an alloy produced through the steps in which the aging treatment temperature was 530° C. In the Comparative Example No. 38, though the bending workability and the strength level were relatively good, it may be considered that the number density of the "coarse second phase particles" having a particle diameter of 100 nm or more and not more than 3 μm became a value exceeding $1.0\times10^6$ number/mm$^2$ due to the fact that the aging treatment temperature was too high, so that the factor of bending deflection was not sufficiently lowered. Incidentally, with respect to of the Comparative Example No. 38, in the "copper alloy sheet material intermediate product" which was provided for the solution treatment, it was confirmed that the number density of the coarse second phase particles exceeded $1.0\times10^6$ number/mm$^2$, and the number density of the fine second phase particles was not more than $5.0\times10^7$ number/mm$^2$.

Comparative Example No. 39 is an alloy having a composition in which the Cr amount is high as 0.34%. It may be considered that because of a high Cr amount, a large amount of the Cr—Si based coarse second phase particles was formed, and the number density of the "ultrafine second phase particles" having a particle diameter of 2 nm or more and less than 10 nm was less than $1.0\times10^9$ number/mm$^2$, so that the strength was insufficient, whereas the number density of the "coarse second phase particles" having a particle diameter of 100 nm or more and not more than 3 μm became a value exceeding $1.0\times10^6$ number/mm$^2$, so that the factor of bending deflection was not sufficiently lowered. Incidentally, with respect to of the Comparative Example No. 39, in the "copper alloy sheet material intermediate product" which was provided for the solution treatment, it was confirmed that the number density of the coarse second phase particles exceeded $1.0\times10^6$ number/mm$^2$, and the number density of the fine second phase particles was not more than $5.0\times10^7$ number/mm$^2$.

The number density of the coarse second phase particles at the time of completion of hot-rolling was in the range of $1.0\times10^5$ number/mm$^2$ or more and not more than $1.0\times10^6$ number/mm$^2$ in Example Nos. 1 to 16 according to the present invention and Comparative Example Nos. 31, 32 and 35 to 38, less than $1.0\times10^5$ number/mm$^2$ in Comparative Example Nos. 33 and 34, and exceeded $1.0\times10^6$ number/mm$^2$ in Comparative Example No. 39, respectively.

The invention claimed is:

1. A copper alloy sheet material having a chemical composition containing from 0.80 to 3.50% by mass of Ni, from 0.50 to 2.00% by mass of Co, from 0.30 to 2.00% by mass of Si, from 0 to 0.10% by mass of Fe, from 0 to 0.10% by mass of Cr, from 0 to 0.10% by mass of Mg, from 0 to 0.10% by mass of Mn, from 0 to 0.30% by mass of Ti, from 0 to 0.20% by mass of V, from 0 to 0.15% by mass of Zr, from 0 to 0.10% by mass of Sn, from 0 to 0.15% by mass of Zn, from 0 to 0.20% by mass of Al, from 0 to 0.02% by mass of B, from 0 to 0.10% by mass of P, from 0 to 0.10% by mass of Ag, from 0 to 0.15% by mass of Be, and from 0 to 0.10% by mass of REM (rare earth element), with the balance being Cu and inevitable impurities, wherein in second phase particles existing in a matrix, a number density of "ultrafine second phase particles" having a particle diameter of 2 nm or more and less than 10 nm is $1.0\times10^9$ number/mm$^2$ or more, a number density of "fine second phase particles" having a particle diameter of 10 nm or more and less than 100 nm is not more than $5.0\times10^7$ number/mm$^2$, and a number density of "coarse second phase particles" having a particle diameter of 100 nm or more and not more than 3.0 μm is $1.0\times10^5$ number/mm$^2$ or more and not more than $1.0\times10^6$ number/mm$^2$; and having a crystal orientation satisfying the following equation (1):

$$I\{200\}/I_0\{200\}\geq3.0 \quad (1)$$

wherein I{200} represents an integrated intensity of an X-ray diffraction peak of the crystal plane on the copper alloy sheet material sheet surface; and $I_0\{200\}$ represents an integrated intensity of an X-ray diffraction peak of the {200} crystal plane in a pure copper standard powder sample.

2. The copper alloy sheet material according to claim 1, wherein a 0.2% yield strength in the rolling direction is 950 MPa or more, a factor of bending deflection is not more than 95 GPa, and an electrical conductivity is 30% IACS or more.

* * * * *